US006853803B1

(12) United States Patent
Chen et al.

(10) Patent No.: US 6,853,803 B1
(45) Date of Patent: Feb. 8, 2005

(54) HIGH-PERFORMANCE WATER HEATER

(76) Inventors: Ming Hsien Chen, No. 13, Alley 5, Lane 12, Sec. 2, Chih Yuan I Rd., Taipei (TW); Steven Chuang, No. 13, Alley 5, Lane 12, Sec. 2, Chib Yuan I Rd., Taipei (TW)

( * ) Notice: Subject to any disclaimer, the term of this patent is extended or adjusted under 35 U.S.C. 154(b) by 0 days.

(21) Appl. No.: 10/720,239

(22) Filed: Nov. 25, 2003

(51) Int. Cl.[7] ..... F24H 1/18
(52) U.S. Cl. ..... 392/441; 165/104.11
(58) Field of Search ..... 392/441, 456, 392/496; 165/104.11, 104.32

(56) References Cited

U.S. PATENT DOCUMENTS 5,228,413 A * 7/1993 Tam ..... 122/15.1
6,577,817 B2 * 6/2003 Harris ..... 392/481

* cited by examiner

*Primary Examiner*—Thor Campbell
(74) *Attorney, Agent, or Firm*—Rosenberg, Klein & Lee

(57) ABSTRACT

A high-performance water heater is constructed to include a heat absorber, the heat absorber defining an oil chamber that holds an oil, a heat guide defining a water chamber, the heat guide having a cold water pipe adapted to guide cold water into the water chamber and a hot water pipe adapted to guide hot water out of the water chamber, a plurality of heat conducting members connected between the heat absorber and the heat guide and adapted to transfer heat energy from the oil in the oil chamber to water in the water chamber of the heat guide, and a heating device adapted to heat the heat absorber.

6 Claims, 8 Drawing Sheets

HIGH-PERFORMANCE WATER HEATER

BACKGROUND OF THE INVENTION

1. Field of the Invention

The present invention water heaters and, more particularly, to a high-performance water heater, which requires less installation space and, directly efficiently heats cold water into hot water.

2. Description of the Related Art

FIG. 1 shows a water heater 1 according to the prior art. The water heater 1 comprises a housing 11, which houses a heating device 12, a heat absorber 13, and a coil pipe 14.

The heating device 12 is disposed below the heat absorber 13. The heat absorber 13 is comprised of a set of heat absorbing fins (not shown). The coil pipe 14 has a middle part extended around the heat absorber 13. The heat absorbing fins of the heat absorber 13 absorb heat from the heating device 12 to heat water passing through the coil pipe 14. Therefore, cold water is heated and become hot when passing through the coil pipe 14.

The aforesaid water heater 1 is still not satisfactory in function because of the following drawbacks:

1. Indirect heating of heat energy: Heat energy from the heating device 12 is directed to heat the coil pipe 14 via the heat absorber 13. This indirect heating action has low heating efficiency and takes much time to make water hot.

2. Easy loss of heat energy: Because the coil pipe 14 extends around the heat absorber 13, the heat exchanging environment between the heat absorber 13 and the coil pipe 14 is an open environment, much heat energy loses during heat exchanging action.

3. High installation space requirement: In order to enhance the heating performance, the heating device 12 and the heat absorber 13 must be made as greater as possible. However, increasing the size of the heating device 12 and the heat absorber 13 relatively increases the size of the coil pipe 14 around the heat absorber 13.

Therefore, it is desirable to provide a water heater that eliminates the aforesaid drawbacks.

SUMMARY OF THE INVENTION

The present invention has been accomplished under the circumstances in view. It is the main object of the present invention to provide a high-performance water heater, which directly heats water, improving the heating efficiency and effectively eliminates loss of heat energy. It is another object of the present invention to provide a water heater, which requires less installation space.

To achieve these and other objects of the present invention, the high-performance water heater comprises a heat absorber, the heat absorber comprising an oil chamber holding an oil; a heat guide, the heat guide comprising a water chamber, a cold water pipe connected to a first side thereof and adapted to guide cold water into the water chamber, and a hot water pipe connected to a second side thereof and adapted to guide hot water out of the water chamber; a plurality of heat conducting members connected between the heat absorber and the heat guide and adapted to transfer heat energy from the oil in the oil chamber to water in the water chamber of the heat guide; and a heating device adapted to heat the heat absorber.

DETAILED DESCRIPTION OF THE PREFERRED EMBODIMENT

Figure 1:
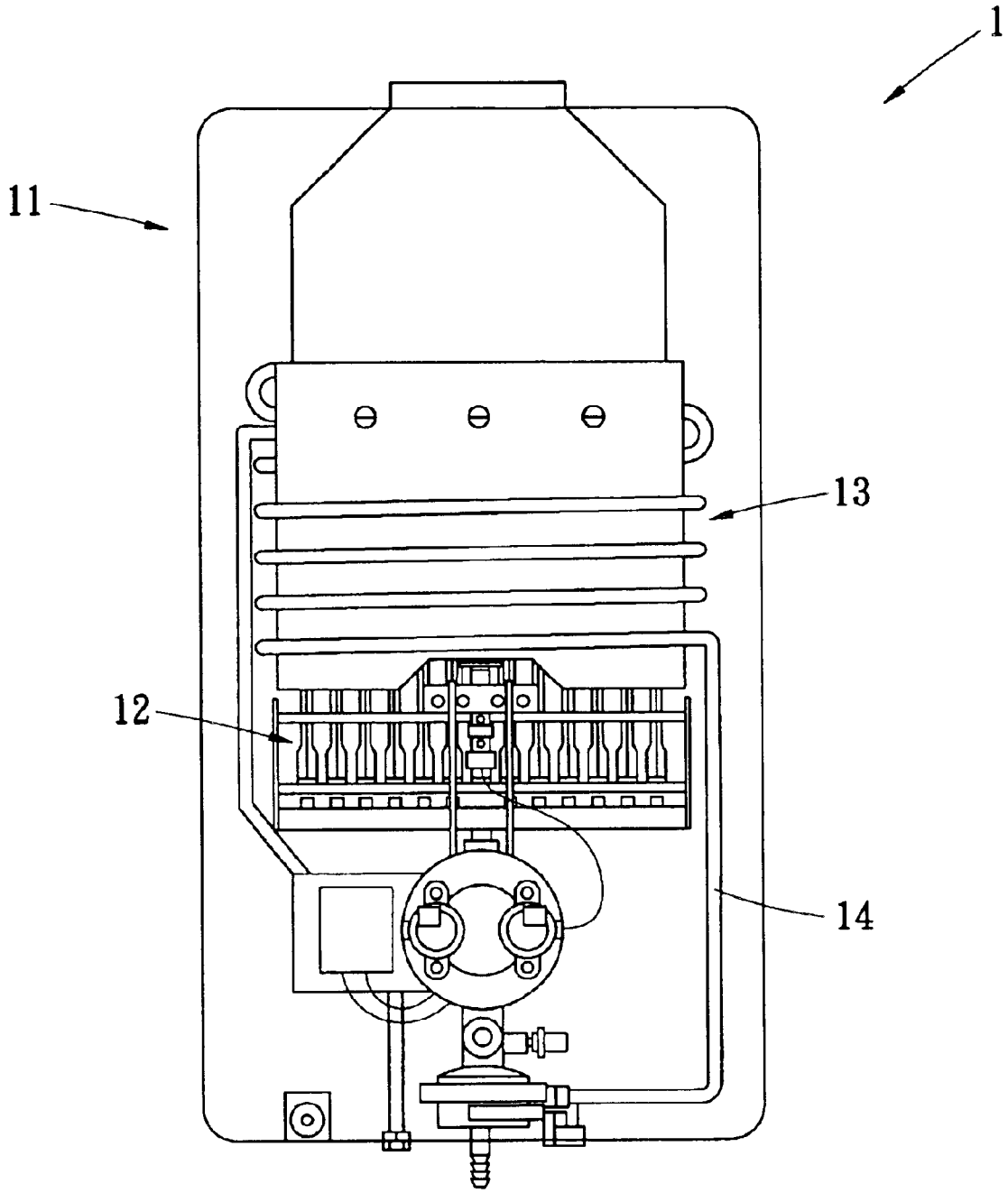
FIG. 1 PRIOR ART
FIG. 1 is a plain view of a water heater according to the prior art.
Figure 2:
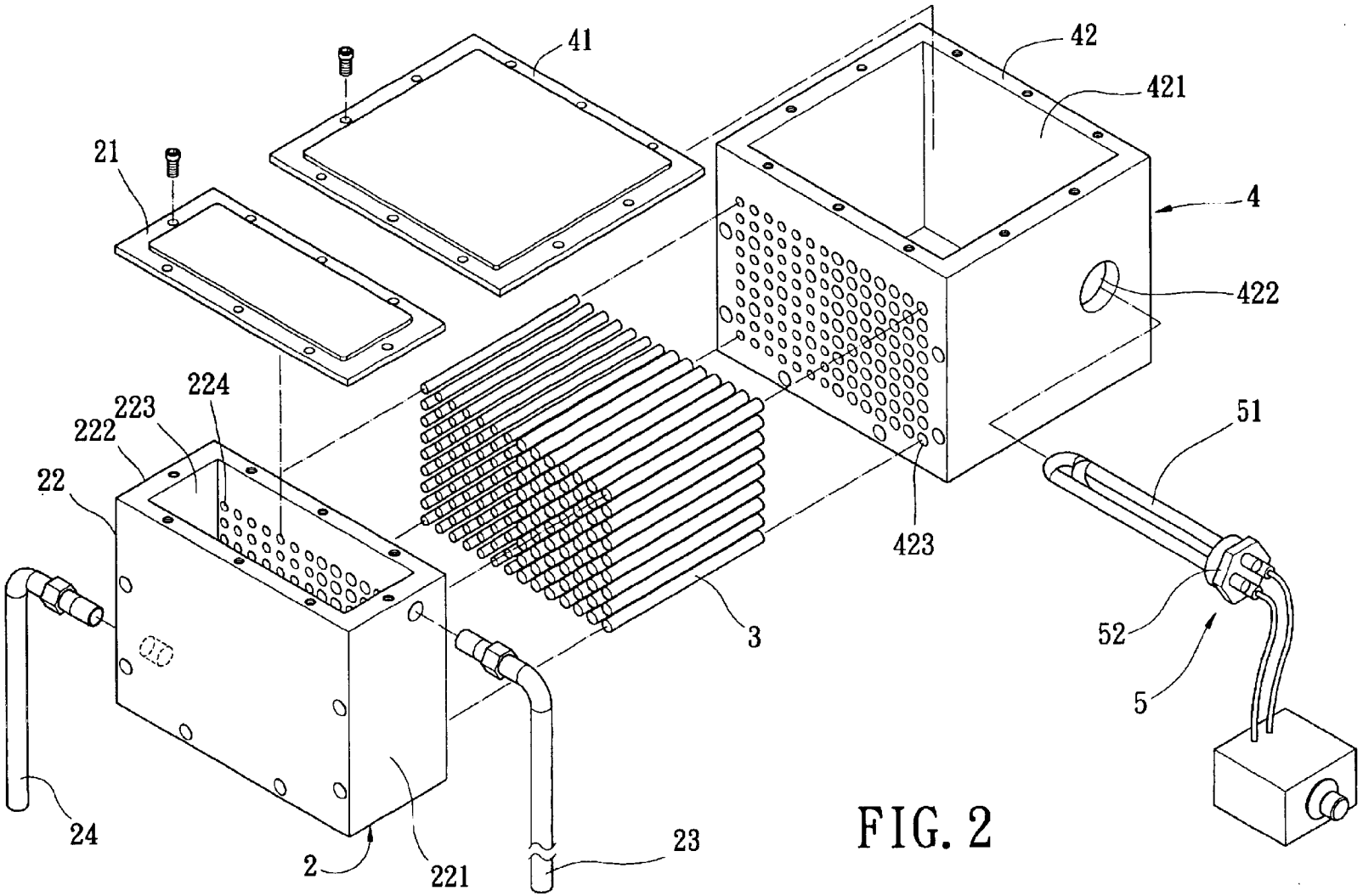
FIG. 2 is an exploded view of a high-performance water heater according to the present invention.
Figure 3:
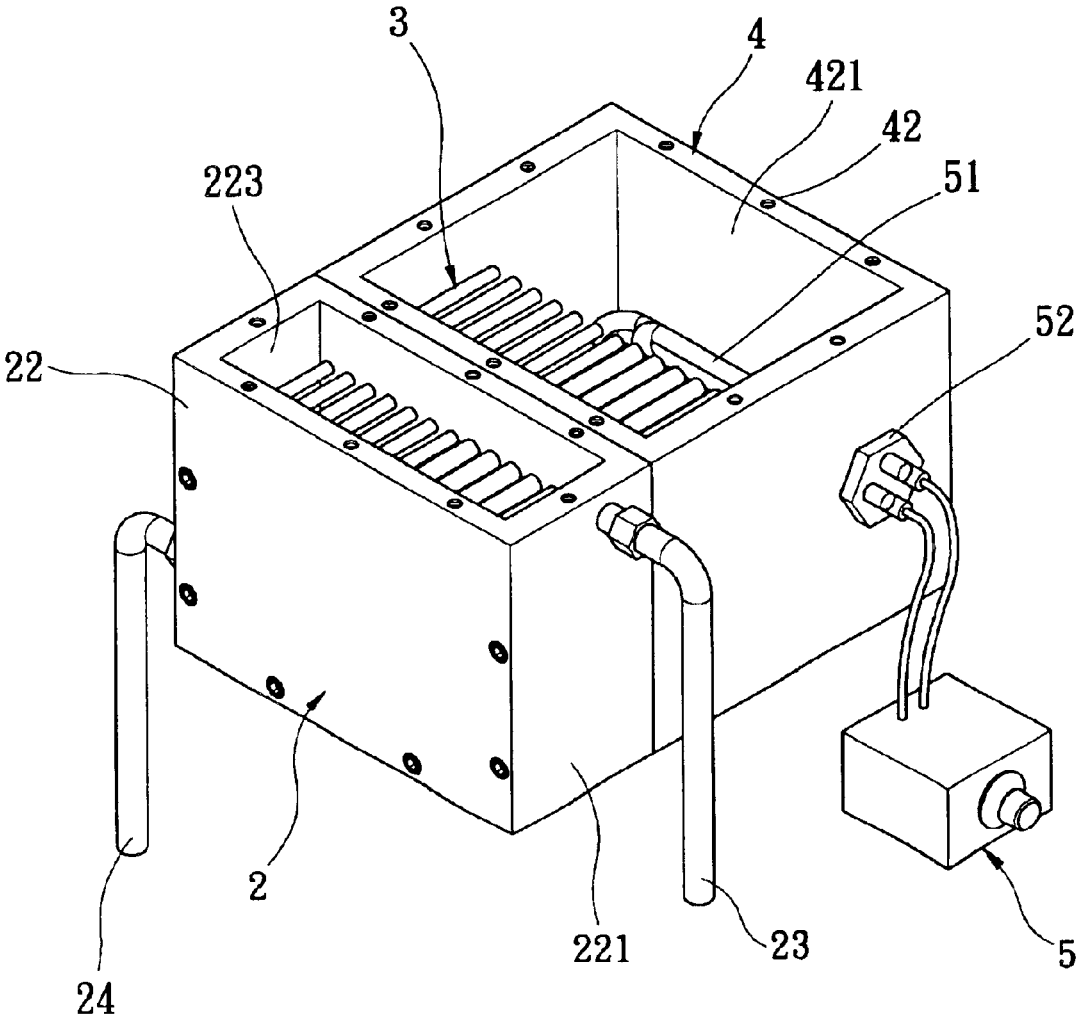
FIG. 3 is an elevational assembly view of the high-performance water heater shown in FIG. 2 (the cover plates excluded).
Figure 4:
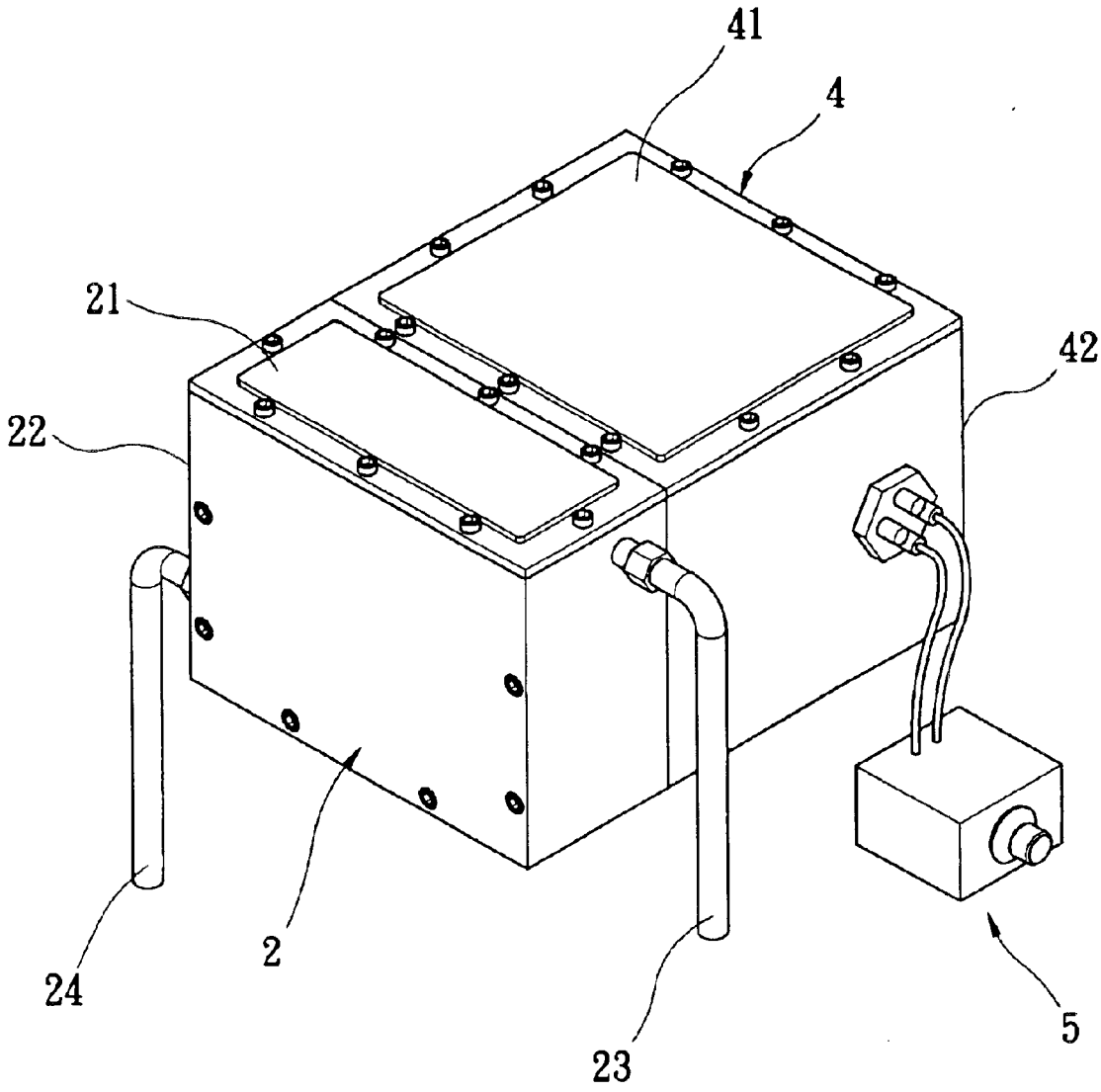
FIG. 4 is similar to FIG. 3 but showing the cover plates installed.

Referring to FIGS. 2~6, a high-performance water heater in accordance with the present invention is shown comprised of a heat absorber 4, a heat guide 2, a plurality of heat conducting members 3, a heating device 5, and a housing (not shown) that houses the aforesaid parts.

The heat absorber 4 comprises a hollow heat absorber body 42 and a cover plate 41 covering the hollow heat absorber body 42. The hollow heat absorber body 42 comprises a top-open oil chamber 421, a plurality of through holes 423 extended through the vertical left sidewall in communication with the top-open oil chamber 421, and a plug hole 422 extended through the vertical front wall.

The heating device 5 is an electric heating device comprising a sealing cap 52 and an electric heating tube 51 forwardly extended from the sealing cap 52. During installation of the heating device 5, the electric heating tube 52 is inserted through the plug hole 422 into the top-open oil chamber 421, and the sealing cap 52 is sealed to the plug hole 422.

The heat guide 2 comprises a hollow heat guide body 22 and a cover plate 21 covering the hollow heat guide body 22. The hollow heat guide body 22 comprises a top-open water chamber 223, a plurality of through holes 224 extended through the vertical right sidewall corresponding to the through holes 423 of the heat absorber body 42, a hot water pipe 23 extended from the vertical front wall 221 near the top, and a cold water pipe 24 extended to the vertical rear wall 222 near the bottom. The hot water pipe 23 and the cold water pipe 24 are respectively disposed in fluid communication with the top-open water chamber 223 for enabling cold water to be guided into the top-open water chamber 223 and hot water to be guided out of the top-open water chamber 223.

The heat conducting members 3 can be solid metal rod members or metal tubes respectively inserted through the through holes 224 at the heat guide 2 and the through holes 423 at the heat absorber 4, having the respective two distal ends respectively suspended in the water chamber 223 and the oil chamber 421.

Figure 5:
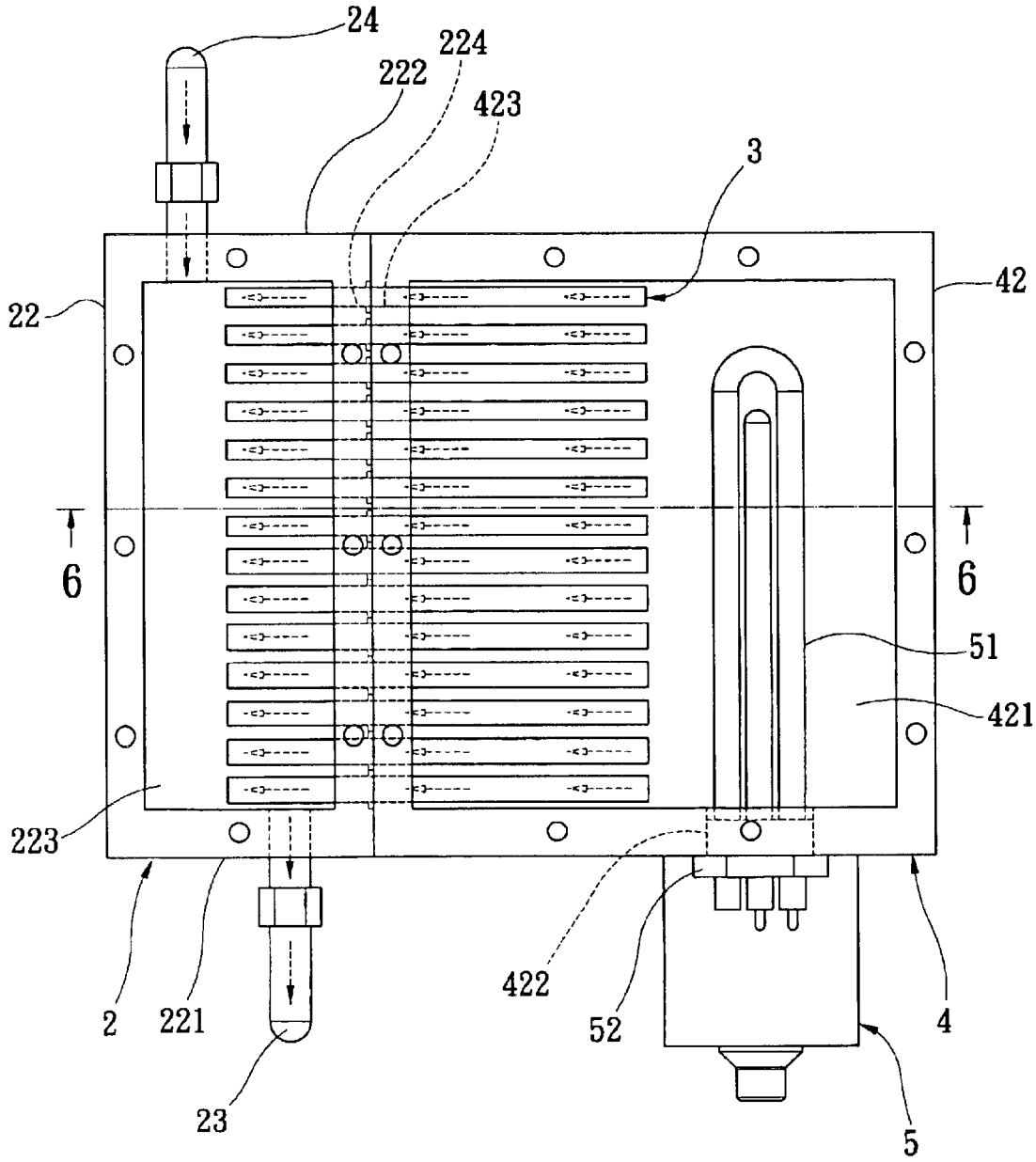
FIG. 5 is a top plain view of FIG. 3.
Figure 6:
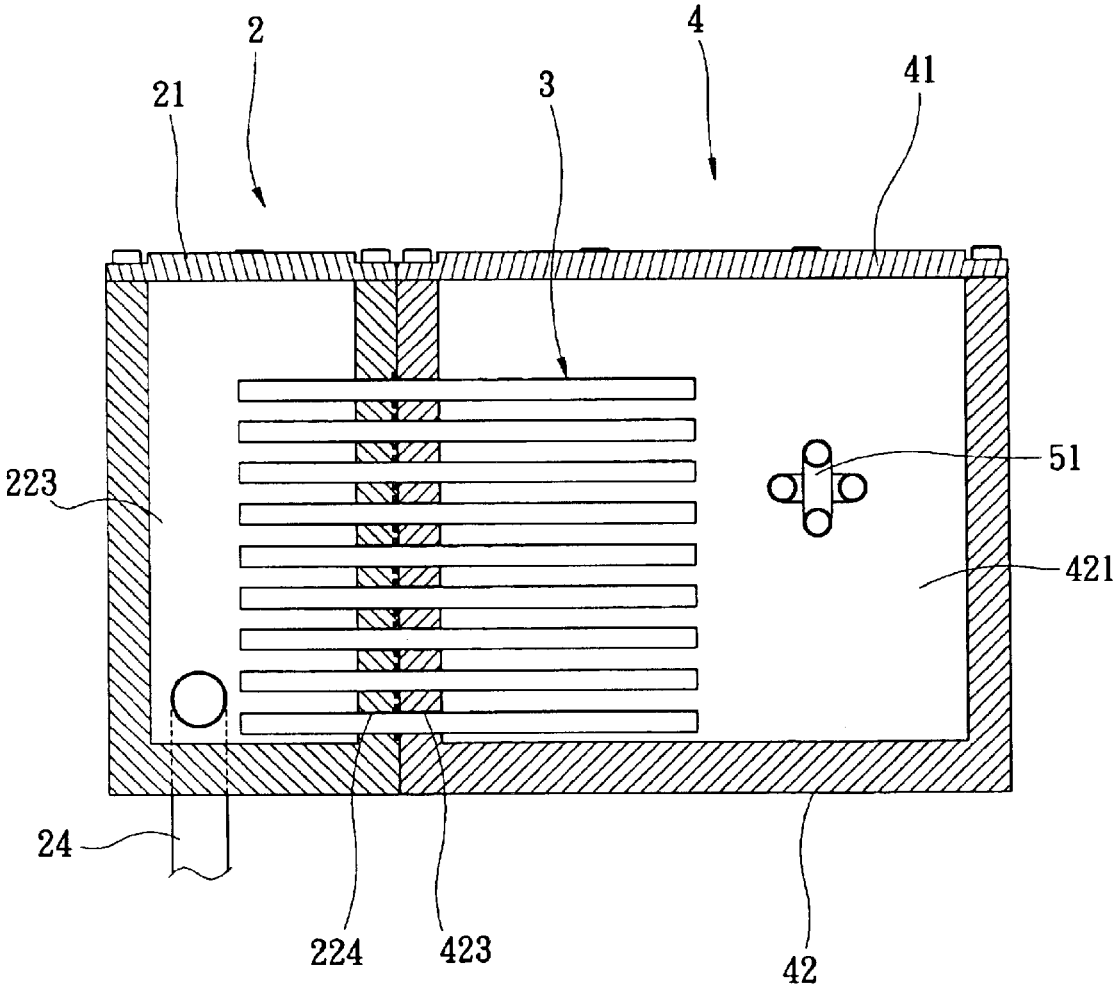
FIG. 6 is a sectional view taken along line 6—6 of FIG. 5.

Referring to FIGS. 5 and 6, the oil chamber 421 of the heat absorber holds an oil that absorbs, guides, and accumulates heat energy. As indicated above, the electric heating tube 51 of the heating device 5 is suspended in the oil chamber 421. When turned on the heating device 5, the electric heating tube 51 directly heats the oil in the oil chamber 421. When hot, the heat conducting members 3 transfer heat energy from the oil in the oil chamber 421 to the cold water in the water chamber 223 at the heat guide 2, thereby causing the cold water to be heated into hot water that flows out of the heat guide 2 through the hot water pipe 23.

Figure 7:
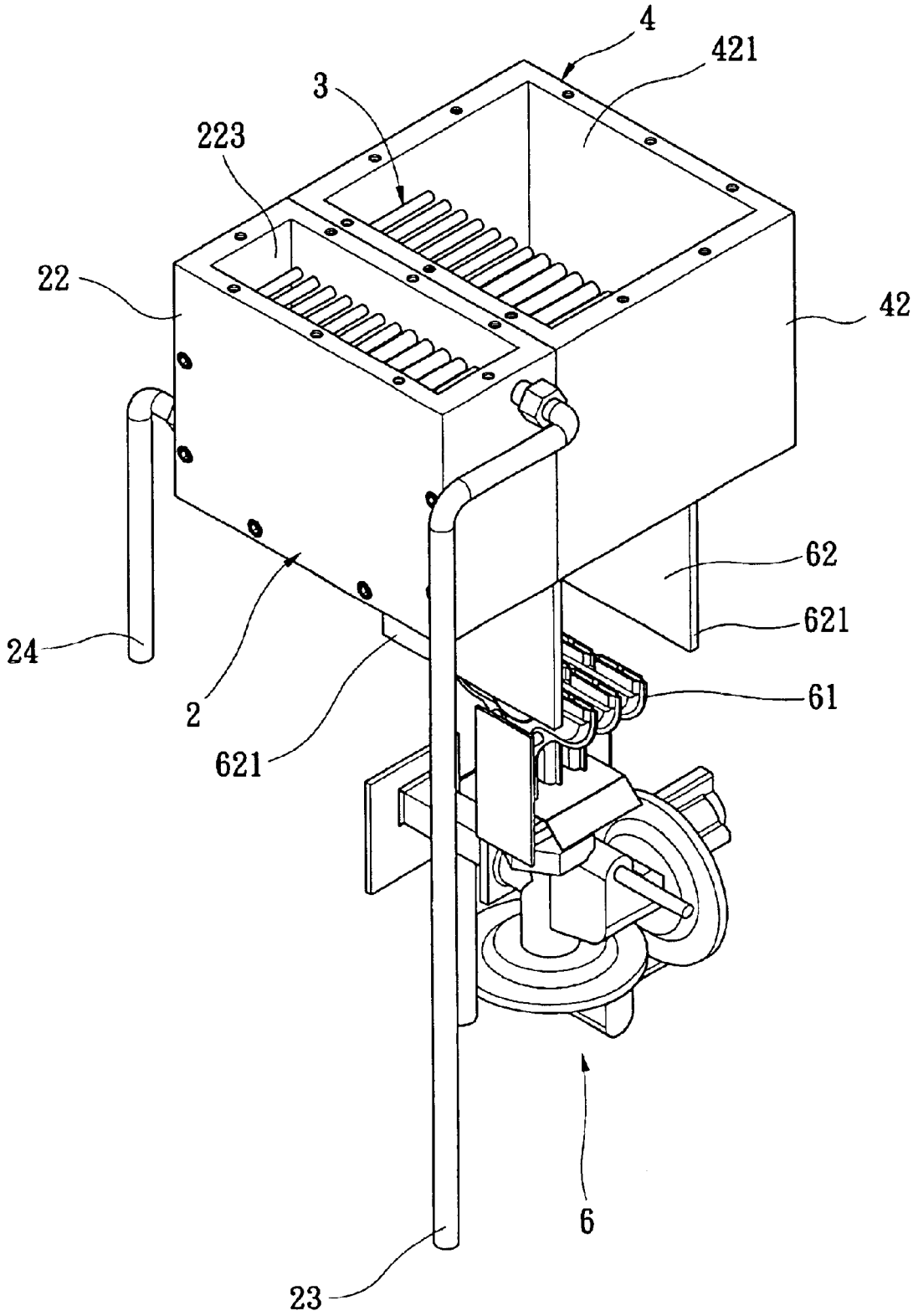
FIG. 7 is an elevational view of an alternate form of the high-performance water heater according to the present invention (the cover plates excluded).
Figure 8:
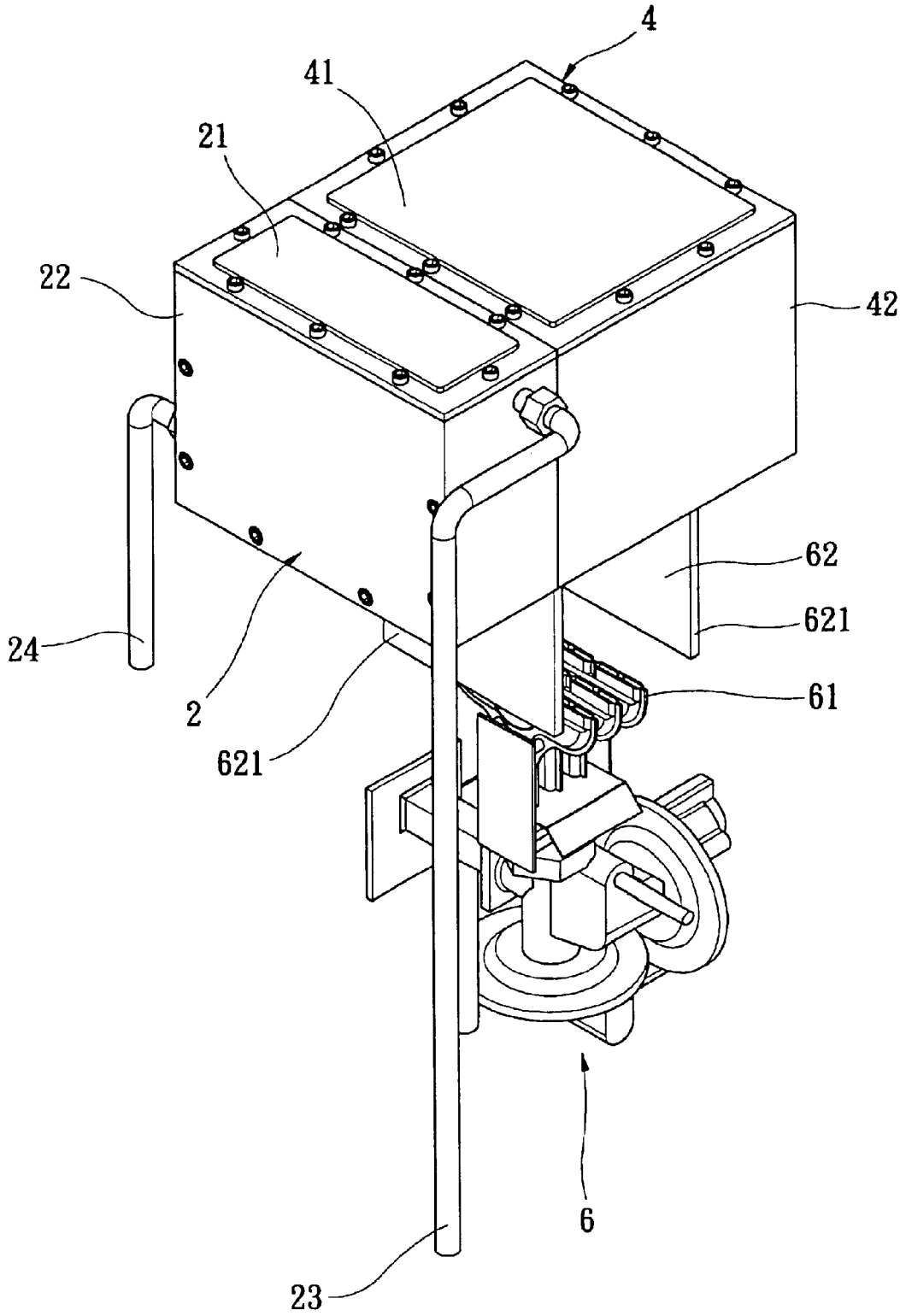
FIG. 8 is similar to FIG. 7 but showing the cover plates installed.

FIGS. 7 and 8 show an alternate form of the present invention. According to this embodiment, a gas burner 6 is provided to substitute the aforesaid heating device 5, and the aforesaid plug hole 422 is eliminated from the heat absorber 4. As illustrated, the gas burner 6 comprises a combustion chamber 62 disposed at the bottom side of the heat absorber 4, and a burner base 61 disposed in the bottom side of the combustion chamber 62. The combustion chamber 62 is formed of a plurality of heat-resisting partition plates 621. During burning of the gas burner 6, the heat absorber 4 transfers heat energy to the oil accumulated in the oil chamber 421, and the heat conducting members 3 transfer heat energy from the oil in the oil chamber 421 to heat cold water in the water chamber 223 at the heat guide 2 into hot water that flows out of the heat guide 2 through the hot water pipe 23.

According to the first embodiment (FIGS. 2~6) and second embodiment (FIGS. 7 and 8) of the present invention, the high-performance water heater has the following features and advantages:

1. Because cold water is disposed in contact with the heat conducting members 3 for direct heating, the heating efficiency is high.

2. Because heat transfer to the oil and heat exchange between cold water and the heat conducting members 3 are respectively performed in the enclosed oil chamber 421 and water chamber 223, heat energy loss is eliminated.

3. The heat absorber 4 holds an oil that absorbs, transfers and accumulates heat energy effectively, dissipation of heat is minimized. Further, the heat conducting members 3 are arranged to form a honeycomb-like structure that transfers heat energy from the heat absorber 4 to the heat guide 2 to heat cold water directly, achieving a high water heating efficiency.

4. Because of high heat-transfer speed, low heat-dissipation speed and high water heating efficiency, no coil pipe is necessary in the water chamber 223 of the heat guide 2, and the size of the heat guide body 22 can be minimized.

5. The water heater can be used with an electric heating device or a gas burner subject to the user's requirement.

A prototype of high-performance water heater has been constructed with the features of the annexed drawings of FIGS. 2~8. The high-performance water heater functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A high-performance water heater comprising:

a heat absorber having an oil chamber holding oil;

a heat guide having a water chamber, a cold water pipe connected to a first side thereof and adapted to guide cold water into said water chamber, and a hot water pipe connected to a second side thereof and adapted to guide hot water out of said water chamber;

a plurality of heat conducting members connected between said heat absorber and said heat guide, and adapted to transfer heat energy from said oil in said oil chamber to water in said water chamber of said heat guide, wherein said heat conducting members are solid heat conducting rods; and a heating device adapted to heat said heat absorber.

2. The high-performance water heater as claimed in claim 1, wherein said heating device is an electric heating device having an electric heating tube inserted into said oil chamber and adapted to heat said oil.

3. The high-performance water heater as claimed in claim 1, wherein said heat absorber comprises a hollow heat absorber body defining said oil chamber, and a cover plate covering said hollow heat absorber body, said heat guide comprises a hollow heat guide body defining said water chamber, and a cover plate covering said hollow heat guide body, and said heat conducting members each have two distal ends respectively inserted through one side of said hollow heat absorber body and one side of said hollow heat guide body and respectively suspended in said oil chamber and said water chamber.

4. The high-performance water heater as claimed in claim 1, wherein said heating device is a gas burner disposed at a bottom side of said heat absorber.

5. The high-performance water heater as claimed in claim 4, wherein said gas burner comprises a combustion chamber disposed below said heat absorber, and a burner base disposed at a bottom side of said combustion chamber.

6. The high-performance water heater as claimed in claim 5, wherein said heat absorber comprises a hollow heat absorber body defining said oil chamber, and a cover plate covering said hollow heat absorber body, said heat guide comprises a hollow heat guide body defining said water chamber, and a cover plate covering said hollow heat guide body, and said heat conducting members each have two distal ends respectively inserted through one side of said hollow heat absorber body and one side of said hollow heat guide body and respectively suspended in said oil chamber and said water chamber.

* * * * *